US006305144B1

(12) United States Patent
Stevens

(10) Patent No.: US 6,305,144 B1
(45) Date of Patent: Oct. 23, 2001

(54) WINDOW FRAME AND METHOD

(75) Inventor: Brad Stevens, Farmington, IL (US)

(73) Assignee: Glass-Stop Concepts, Inc., Farmington, IL (US)

( * ) Notice: Subject to any disclaimer, the term of this patent is extended or adjusted under 35 U.S.C. 154(b) by 0 days.

(21) Appl. No.: 09/532,056

(22) Filed: Mar. 21, 2000

(51) Int. Cl.[7] ..... E04B 1/61

(52) U.S. Cl. ..... 52/773; 52/476; 52/204.7; 52/204.591

(58) Field of Search ..... 52/476, 773, 204.53, 52/204.54, 204.591, 204.595, 204.62, 204.69, 204.7, 204.71, 204.72, 214, 202

(56) References Cited

U.S. PATENT DOCUMENTS

| | | | | |
|---|---|---|---|---|
| 1,966,196 | * | 7/1934 | Benoit | 49/459 |
| 2,003,982 | * | 6/1935 | Swanson | 52/202 |
| 2,765,057 | * | 10/1956 | Stiefvater | 52/773 |
| 2,840,202 | | 6/1958 | Hehr | 189/75 |
| 2,865,063 | * | 12/1958 | Hartshrn | 52/773 |
| 2,996,767 | | 8/1961 | Kobil et al. | 20/56.4 |
| 3,086,326 | | 4/1963 | Becker et al. | 50/122 |
| 3,323,262 | | 6/1967 | Di Cesare, Jr. et al. | 52/212 |
| 3,423,897 | * | 1/1969 | Birum, Jr. | 52/502 |
| 4,275,526 | | 6/1981 | Abramson | 49/501 |
| 5,111,621 | | 5/1992 | Meyers | 49/504 |
| 5,483,779 | | 1/1996 | Crawford et al. | 52/645 |
| 5,655,343 | | 8/1997 | Seals | 52/217 |
| 5,779,384 | | 7/1998 | Olsen | 403/231 |

* cited by examiner

*Primary Examiner*—Carl D. Friedman
*Assistant Examiner*—Naoko Slack
(74) *Attorney, Agent, or Firm*—Senniger, Powers, Leavitt & Roedel

(57) ABSTRACT

A window frame comprising a sill, a pair of side jambs and a header is provided. The sill, side jambs, and header include coextensive window pane receiving grooves in which the window pane and glazing are received for mounting the window pane in the window frame. The sill and side jambs are of unitary construction. The header is two piece construction to facilitate installation of the window pane in the frame. The header includes a filler strip that releasably retains a window pane in place in the window frame and the filler cooperates with the remainder of the header to form the window pane groove in the header. A method of installing the window pane in the window frame is also provided.

20 Claims, 6 Drawing Sheets

WINDOW FRAME AND METHOD

BACKGROUND OF THE INVENTION

The present invention relates generally to window frames that are mounted in wall openings, and to methods of installing window panes in such frames.

In commercial and industrial buildings, window panes arc generally secured in frames that are mounted in openings in the building structure. Such frames take many forms but typically include a sill, two side jambs and a header. A window pane receiving groove or the like is provided in the frame. A window pane is placed in the groove and sealant or a seal strip (generally referred to as glazing) is inserted into the groove on opposite sides of the window pane to seal and hold the window pane in place.

The inside dimensions of the window frame opening are smaller than the outer dimensions of the window pane, thus requiring some means for inserting the window pane into the window pane groove through the window frame opening. One way to accomplish this is to have removable window pane retainer strips that when removed, provide a larger frame opening permitting insertion of the window pane. Installation of the retainer strips around the periphery of the window pane secures it in the frame. The retainer strips are held in place by screws or some other fastener means. One such frame is disclosed in U.S. Pat. No. 3,323,262. This structure is very complex, requiring a large number of parts to work. The frame uses two-piece frame members that are clamped in place in the structural opening by screws cooperating with component parts of the frame members. Retainer strips abut the window pane when installed and are screwed in place around the entire periphery of the window pane to retain the window pane in place. U.S. Pat. No. 2,840,202 shows another window frame that is held in place in a structural opening by a tooth and pawl arrangement. The window pane is retained in place by a bead of glazing. While such designs have been somewhat effective in use, they are complicated in structure and require complex manufacturing and time consuming installation techniques.

Window frames and window panes used in commercial and industrial buildings can be large and many times need to be installed at elevated locations. This poses both safety and expense problems. When there is a pressure differential across the window pane, large forces can be generated making installation difficult. Also, the window pane needs to be positively secured in place to prevent loss of the window pane and any subsequent damage the loss may cause. Thus, window frames need to be effective in positively retaining the window pane and easy for installers to install in structures, both new and pre-existing. Many times, window installation is done at elevated positions making installer safety a major concern. Further, because elevated work is dangerous, it requires skilled workers who command high salaries. Thus, a window frame needs to be designed to provide for easy, sure, and quick installation, present minimal safety issues for the installer and reduce labor costs for installation. After the window frame is installed, the same concerns about safety and cost apply to the installation of the window pane in the window frame. In addition, the loss of a window pane during installation can cause a safety risk to people and property in the vicinity. Thus, the window frame needs to be adapted for easy, quick, and sure installation of the window pane.

After installation, window repair is frequently needed. Concerns over expense and safety are the same for repair as they are for initial installation. Thus, the window frame needs to be easy to operate to remove old panes and install new panes.

Thus, there is a need for a window frame that is easy and economical to manufacture and simple and quick to install in wall openings. The window frame should have a minimum number of parts that need to be installed to secure a window pane and provide for positive retention of the window pane.

SUMMARY OF THE INVENTION

Among the several objects and features of the present invention may be noted the provision of a window frame that is easy to install in new construction and in pre-existing structures; the provision of a window frame that provides for easy installation and removal of window panes; the provision of a window frame that is simple in construction and uses few parts; the provision of a window frame that is effective in positively retaining window panes therein; the provision of a window frame that holds the window pane in place with integral retainer strips on both sides of the window pane that eliminates aesthetically objectionable visible screws and eliminates a failure point in the window frame; the provision of a window frame that uses fasteners to hold the frame in place in a structure where the fasteners are shielded from the outside environment when the window pane is installed; the provision of a window frame that can be manufactured from steel using simple manufacturing techniques and inexpensive components; the provision of a method of installing a window pane in a window frame that is simple to carry out and positively retains the window pane in place; and the provision of such a method that retains the pane against accidental loss during installation.

The present invention involves the provision of a window frame unit adapted to secure a window pane in place in a window opening. The window frame unit is adapted to be mounted in an opening in a wall defined by a plurality of casings members. The window frame includes an elongate sill having a window pane receiving groove extending along the length of the sill. A pair of elongate side jambs is provided with each having a window pane receiving groove extending along the length of the respective side jamb. An elongate header having an elongate slot extending along the length of the header is also provided. An elongate filler strip is positioned in the header slot reducing the transverse width of the header slot and forms with the header, a window pane receiving groove in the header. The sill, side jambs and header are positioned relative to one another to form a window frame with the sill groove, side jamb grooves and header groove forming a substantially continuous window pane receiving groove around the inside periphery of the window frame. Lock means cooperates with the header and the filler strip to releasably retain the strip in the header.

The present invention also involves the provision of a window frame unit adapted to secure a window pane in place in a window opening. The window frame unit is adapted to be mounted in an wall opening defined by a plurality of casings members. The window frame unit includes an elongate sill having a window pane receiving groove extending along the length of the sill. The sill has a pair of spaced apart sill legs on opposite sides of and extending from a sill web, the sill legs have inside surfaces facing one another. The window frame also includes a pair of elongate side jambs each having a window pane receiving groove extending along a length of a respective side jamb. Each side jamb has a pair of spaced apart side jamb legs on opposite sides of and extending from a respective side jamb web with the side jamb legs of each side jamb having inside surfaces facing one another. An elongate header has a groove extending along the length of the header and has a pair of spaced apart header legs on opposite sides of and extending from a header web. The header legs have inside surfaces facing one another. A plurality of spaced apart reinforcing members extend transversely between the inside surfaces of the sill legs, the inside surfaces of the side jamb legs and the inside surfaces of the header legs to reinforce the legs from bending inwardly.

The present invention further involves the provision of a method of installing a window pane in a window frame that includes a sill, a pair of side jambs and a header. The method includes positioning a first side edge of the window pane in a first edge groove of a first side jamb of the aforesaid pair of side jambs. The bottom edge of the window pane is thereafter moved over and then into a bottom groove in the sill. A second side edge of the window pane is moved into a second edge groove in a second side jamb by laterally moving the window pane. After the window pane is in position, a first header channel is joined to a preinstalled second header channel to secure the window pane in place in the window frame.

The present invention additionally involves the provision of a window frame adapted to secure a window pane in place in a window opening. The window frame is adapted to be mounted in an opening in a wall defined by a plurality of casings members. The window frame includes an elongate generally horizontal sill having a first window pane receiving groove extending along the length of the sill. There is a pair of generally vertical elongate side jambs each having a second window pane receiving groove extending along the length of the respective side jamb. The frame also includes a generally horizontal elongate header having a third window pane receiving groove extending along the length of the header. The sill, side jambs and header are positioned relative to one another to form a generally rectangular window frame with the first, second and third grooves forming a substantially continuous window pane groove around the inside periphery of the window frame. At least one of the sill, side jambs and header comprises a pair of channels forming an elongate slot there between forming a portion of said continuous window pane groove. An elongate filler strip is releasably retained in the slot reducing the transverse width of the slot and forming with one of the channels, the portion of the continuous window pane receiving groove in said at least one of the sill, side jambs and header. Lock means cooperates with one of the channels and the filler strip to releasably retain the strip in at least one of the sill, side jambs and header.

Other objects and features will be in part apparent and in part pointed out hereinafter.

BRIEF DESCRIPTION OF THE DRAWINGS

Corresponding reference characters indicate corresponding parts throughout the several views of the drawings

DETAILED DESCRIPTION

Figure 1:
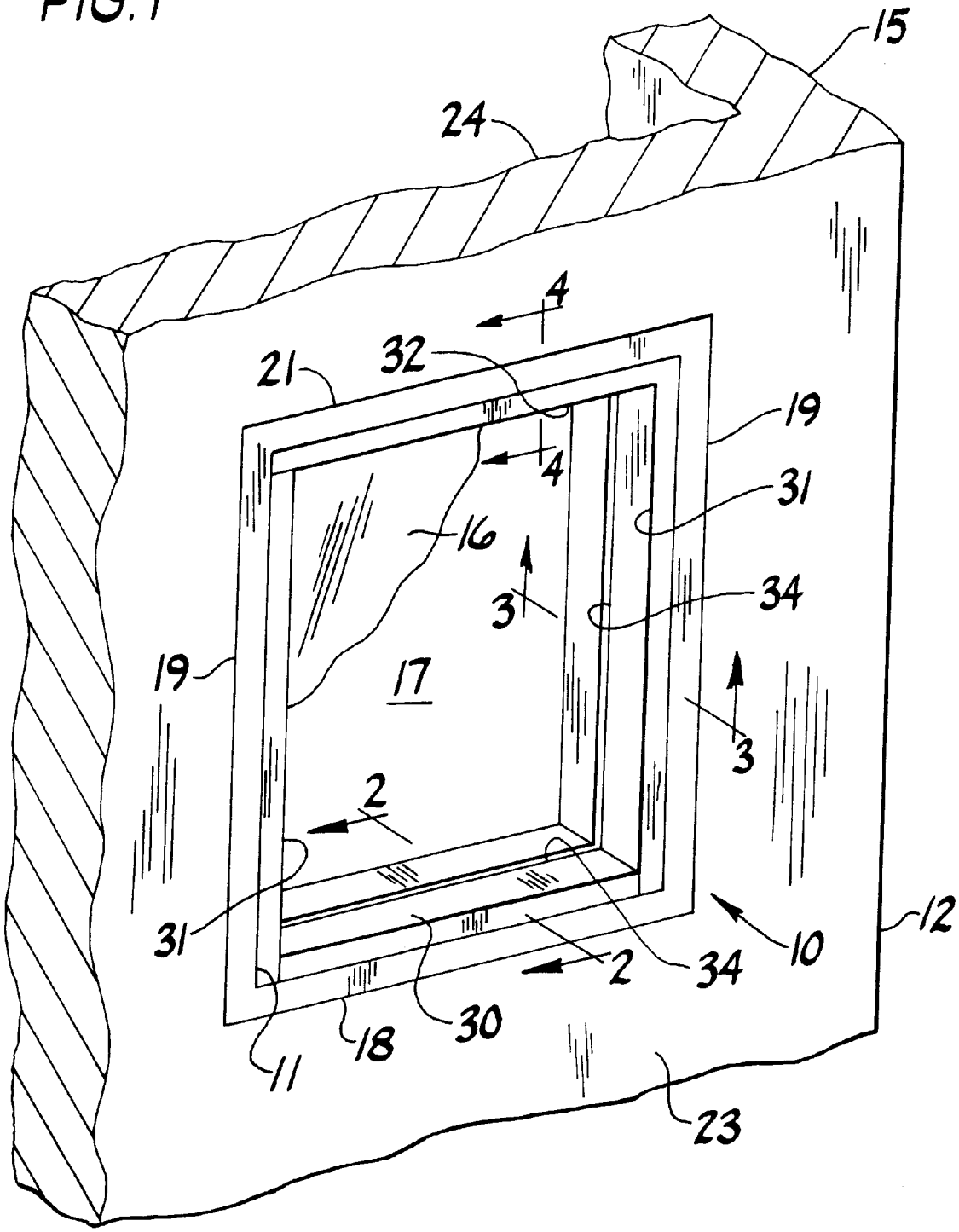
FIG. 1 is a fragmentary perspective view of a window frame installed in a window opening in a building wall.

The reference numeral 10 generally designates a window frame (FIG. 1). The window frame 10 is mounted in a wall opening 11 in a wall 12 or the like of a building 15. The window frame 10 is operable to retain a window pane 16 in a window opening 17 defined by the window frame 10. The window frame 10 and window pane 16 close the wall opening 11. The wall opening 11 is defined by a plurality of casing members 18, 19, 21 extending between opposite surfaces 23, 24 of the wall 12. The casing members 18, 19, 21 have riser strips 27 secured thereto extending into the wall opening 11. Alternately, the riser strips 27 may be an integral part of the respective casing member 18, 19, 21. The casing member 18 is a sill, the casing members 19 are side jambs and the casing member 21 is a header. The casing members 18, 19, 21 can be metal such as galvanized steel.

Figure 3:
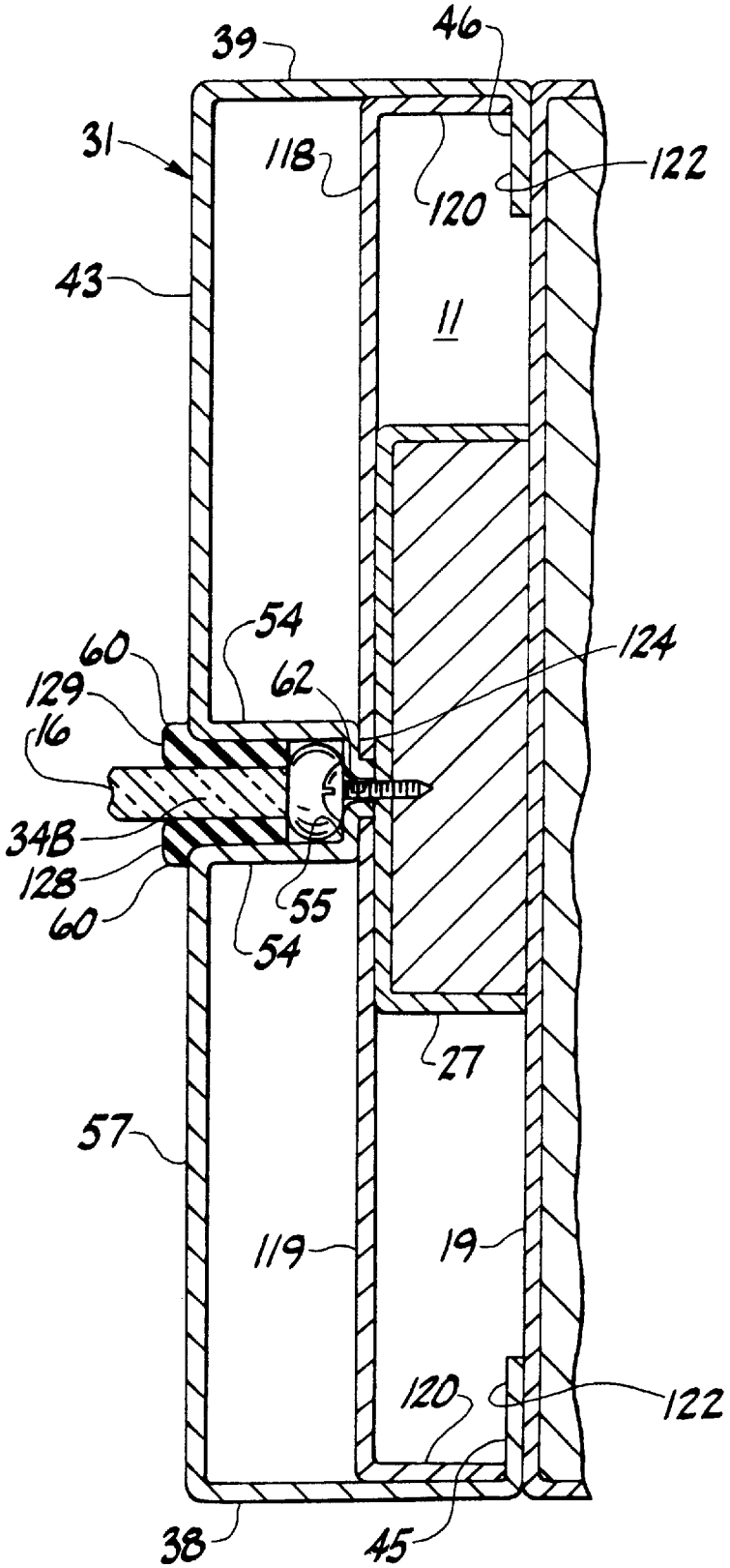
FIG. 3 is a sectional view of the window frame taken along the line 3—3 in FIG. 1 showing a side jamb of the window frame.
Figure 4:
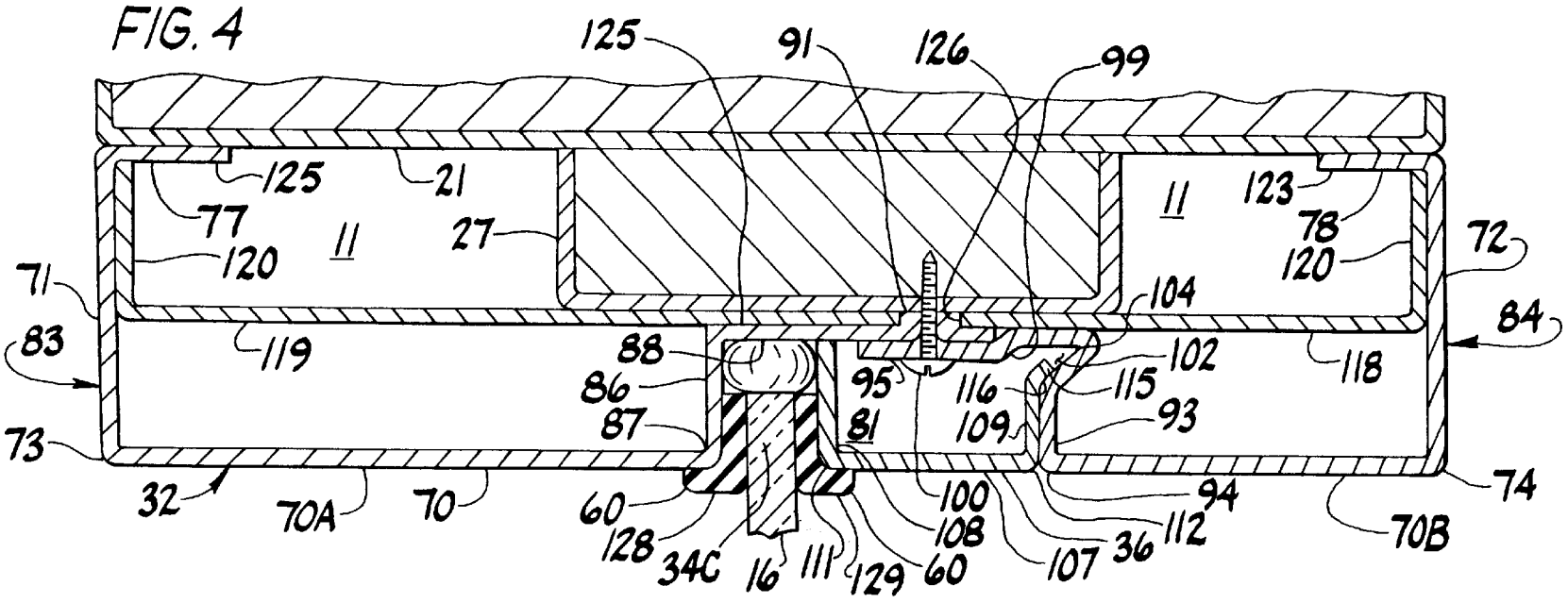
FIG. 4 is a sectional view of the window frame taken along the line 4—4 in FIG. 1 showing a header of the window frame.

The window frame 10 is generally rectangular and is comprised of a plurality of frame members including a generally horizontal sill 30 (FIG. 2), two generally vertical side jambs 31 (FIG. 3) and a generally vertical header 32 (FIG. 4). The frame members 30, 31, 32 combine to form an outwardly extending (relative to the window opening 17) window pane receiving groove 34 opening into the window opening 17 and extending entirely around the inside periphery of the window frame 10. The window pane 16 is mounted in the groove 34 and is removably retained therein. A retention filler strip 36 is mounted in one of the frame members in a slot and locks or releasably retains the window pane 16 in place in the window frame 10 as hereinafter described.

Figure 2:
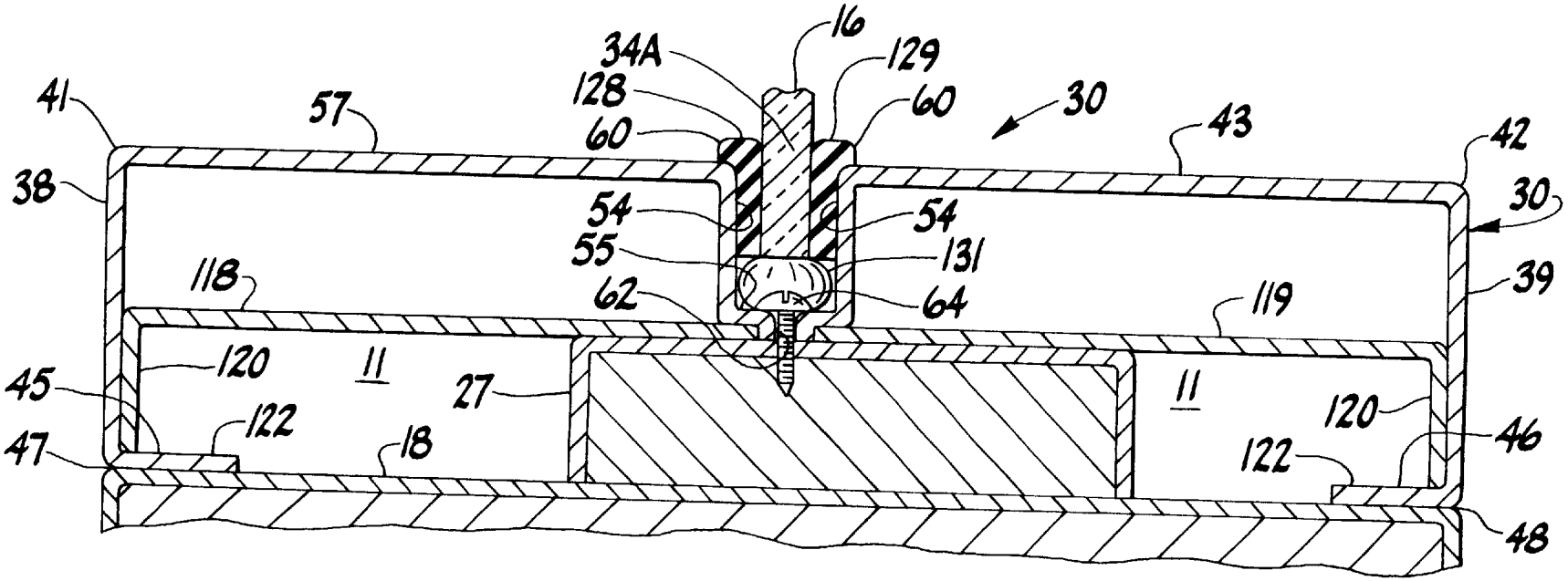
FIG. 2 a sectional view of the window frame taken along the line 2—2 in FIG. 1 showing a sill of the window frame.

As seen in FIGS. 1, 2, the sill 30 is elongate and includes a pair of generally vertical legs 38, 39 connected to and extending downwardly from opposite side edges 41, 42 of a generally horizontal substantially planar web 43. The legs 38, 39 each include an inturned flange 45, 46, respectively, that is preferably bent at a generally right angle to its respective leg and generally parallel to the web 43 and extends inwardly from a bottom edge 47, 48 of the respective legs 38, 39 and engage the casing 18. The sill 30 includes a window pane receiving groove 34A that is defined by a pair of side walls 54 extending from the exposed surface 57 of the web 43 into the interior of the sill 30 and a bottom wall 55. The side walls 54 are at a generally right angle to the web 43 and the bottom wall 55 is generally parallel to the web 43. The height and width of the groove 34A are sized to accommodate the window pane 16 and glazing 60 (hereinafter described).

Figure 5:
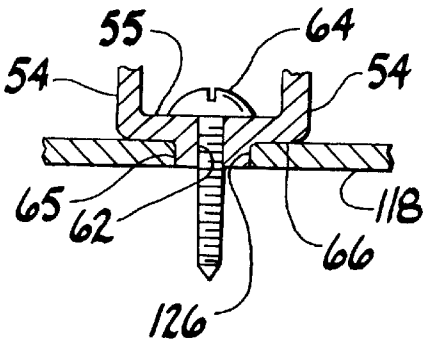
FIG. 5 is an enlarged fragmentary sectional view of a window pane groove in a sill or side jamb showing details of the groove bottom wall and support bar.

The sill 30 is provided with means for securing it to the wall 12 in which the window frame 10 is mounted or secured. As seen in FIG. 2, the sill 30 has a series of holes 62 through the bottom wall 55 spaced at intervals along the length of the sill. Preferably the holes 62 are spaced apart a distance in the range of between about 6 inches and about 12 inches and preferably about 10 inches. The sill 30 is secured to the wall 12 with mechanical fasteners 64 extending through the holes 62 and into the sill casing 18. The type of mechanical fastener will in large part be determined by the type of material that the sill casing 18 is made of. Suitable fasteners include self tapping screws such as Tek screws when the casing members 18, 19, 21 are metal. The holes 62 are formed in a manner, such as punching and upsetting, which leaves an annular boss 65 (FIG. 5) projecting from the backside 66 of the bottom wall 55. The annular bosses 65 are for a purpose described hereinafter.

The sill 30 is preferably formed of metal. A preferred metal is galvanized steel that can be roll formed. The thickness of the metal is preferably in the range of between about 0.030 inches thru about 0.060 inches and is more preferably about 0.055 inches. The use of steel provides better fire resistance than aluminum and aluminum alloy frames. Also, for decoration, the metal can be coated with a decorative finish such as paint.

The elongate side jambs 31, as shown in FIGS. 1 and 3, are of the same construction as the sill 30. Each has a web 43, legs 38, 39, flanges 45, 46, a groove 34B formed by side and bottom walls designated 54 and 55, respectively and holes 62 in the bottom wall. The description of the sill 30 also applies to the side jambs 31. The use of the same construction for the sill 30 and the side jambs 31 simplifies manufacture and reduces the number of different types of parts required to make a window frame 10. It is preferred that the side jambs 31 and sill 30 each be of unitary construction with the component parts thereof being integral. It is also preferred that they have a uniform cross sectional shape along their entire length to facilitate manufacture, e.g., by roll forming.

The elongate header 32 (FIGS. 1 and 4), like the sill 30 and side jambs 31, has a web 70 (preferably planar), legs 71, 72 connected to and extending from side edges 73, 74 of the web 70 and intumed flanges 77, 78 extending inwardly from legs 71, 72 respectively. The web 70 has two portions, 70A and 70B hereinafter described. The header 32 has a slot 81 that is laterally wider than the grooves 34A, 34B in the sill 30 and side jambs 31. The header 32, however, is of two piece construction to simplify its installation in the window frame 10. Two-piece construction also simplifies installing the window pane 16 in the window frame 10.

The header 32 includes first and second elongate channels 83, 84, respectively, which when positioned in side-by-side relation, form the header 32 and the longitudinally extending header slot 81. The first channel 83 includes a web portion 70A connected to the leg 71 at the outside edge 73 of the web portion 70A. The inturned flange 77 is connected to the leg 71 and extends inwardly from the leg 71. Preferably the leg 71 is generally perpendicular to the web portion 70A and the flange 77 is generally perpendicular to the leg 71 and generally parallel to the web portion 70A. A side wall 86 is connected to the web portion 70A at an inside edge 87 of the web portion 70A and extends generally perpendicular to the web portion 70A. A bottom wall 88 is connected to the side wall 86 at a distance from the web portion 70A and is generally perpendicular to the side wall 86 and generally parallel to the web portion 70A. The side wall 86, bottom wall 87, web portion 70A, leg 71, and inturned flange 77 extend along the length of the header 32. Notches 90 are provided in the bottom wall 88 and extend transversely of the wall 88 at intervals spaced longitudinally thereof. The notches 90 open at the side edge 92 (FIG. 6) of the wall for a purpose described below. The notches 90 are spaced apart along the length of the channel 83.

The second channel 84 (FIG. 4) is similar to the first channel 83. The second channel 84 includes a web portion 70B connected to the leg 72 at an outside edge 74 of the web portion 70*b*. The inturned flange 78 is connected to the leg 72 and extends inwardly from the leg. Preferably, the leg 72 is generally perpendicular to the web portion 70B and the flange 78 is generally perpendicular to the leg 72 and generally parallel to the web portion 70B. A side wall 93 is connected to the web portion 70B at an inside edge 94 of the web portion 70B and extends generally perpendicular to the web portion 70B. A bottom wall 95 is connected to the side wall 93 at a distance from the web portion 70B, is generally perpendicular to the side wall 93 and generally parallel to the web portion 70B. The side walls 86, 93 and bottom walls 88, 95 define the slot 81. The side wall 93, bottom wall 95, web portion 70B, leg 72, and inturned flange 78 extend along the length of the header 32. The bottom wall 95 includes a bend 99 extending along the length of the bottom wall of the second channel 84. A portion of the bottom wall 95 overlaps at least a portion of the bottom wall 88 of the first channel 83 with the bend 99 accommodating the thickness of the bottom wall 88 so that the top faces of the two bottom walls are generally conplanar. The bottom wall 95 has holes 98 that align with the notches 90 so mechanical fasteners 100 can extend thru the aligned holes and slots to secure the header 32 in place in the wall opening 11. The fasteners 100 can be the same as the fasteners 64. The holes 98 are surrounded by annular bosses 91 similar to the annular bosses 65.

Figure 6:
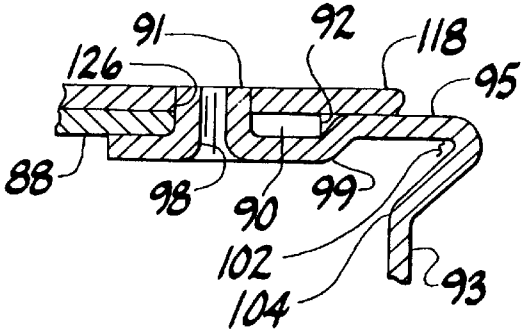
FIG. 6 is an enlarged fragmentary sectional view of a window pane groove in a header showing details of the relationship of the interconnection of the channels forming the header and the support bar.

The second channel 84 includes an elongate lock groove 102 at the juncture between the side and bottom walls 93, 95 respectively. Preferably, the lock groove 102 extends along substantially the entire length of the second channel 84 and thus the header 32. The purpose of the lock groove 102 is described hereinafter. As seen in FIG. 6, the lock groove 102 is defined on one side by an upwardly and outwardly sloping surface 104 and on another side by the bottom wall 95.

The elongate retention filler strip 36 (FIG. 4) is received in the slot 81 defined by the side walls 86, 93 and bottom walls 88, 95 and reduces the transverse width of the slot 81. In a preferred embodiment, the filler strip 36 is generally channel shaped, comprising a web 107 connected to two legs 108, 109 preferably extending generally at right angles to the web 107 from opposite side edges 111, 112 respectively. The legs 108, 109 are resiliently deformable in bending toward and away from one another to facilitate installation and removal of the filler strip 36. The overall height of the filler strip 36 is approximately the same as the depth of the slot 81 so that the outer surface of the web 107 is generally coplanar with the outer surface of the web portions 70A, 70B. The side legs 86, 108 and the bottom wall 88 define the window pane receiving groove 34C in the header 36. The filler strip 36 includes a laterally outwardly extending tongue 115 at the end of the leg 109. The tongue 115 extends the full length of the filler strip 36. Preferably, the tongue 115 is characterized by a smooth transition from the leg 109 to be free of sharp corners. The tongue 115 is sized and shaped to fit in the lock groove 102 and to be releasably retained by interlocking within the lock groove to releasably retain the filler strip 36 within the slot 81. As shown, the lock groove 102 is generally triangularly shaped. Alternatively, the tongue 115 could be part of the channel 84 and the lock groove 102 could be in the filler strip 36.

It is preferred that the channels 83, 84 and the filler strip 36 each be of a unitary structure and that the component parts of each be integral with one another. It is also preferred that the channels 83, 84 and filler strip 36 each have a uniform cross sectional shape along its entire length to facilitate manufacture, e.g., by roll forming. The channels 83, 84 and filler strip 36 can be made of the same material as the sill 30.

The window pane receiving grooves 34A, 34B, 34C form a continuous groove 34 around the entire periphery of the window frame 10 and opens into the inside of the window frame 10 and extends outwardly from the inside periphery of the window frame 10.

Lock means is provided to releasably retain the filler strip 36 in the slot 81 in the header 32. Any suitable lock means can be used and preferably it is of a snap lock type not requiring mechanical fasteners such as screws. As seen in FIG. 4, the lock means includes the tongue 115 and lock groove 102 described above. When the filler strip 36 is installed in the slot 81, and a window pane 16 is in the window pane groove 34, the tongue 115 is positioned in the lock groove 102 and its surface 116 interengages with the lock groove surface 104 to releasably retain the filler strip 36 in place. To remove the filler strip 36, a prying device can be inserted between the leg 109 and the side wall 93 of the channel 84 to disengage the tongue 115 from the lock groove 102, thereby allowing the filler strip to be removed.

Leg reinforcing means is provided to reinforce the frame member legs 38, 39, 71, 72 from bending inwardly. As best seen in FIGS. 2, 3, and 4, the reinforcing means includes a plurality of spaced apart bars 118. Preferably, the bars 118 are generally U-shaped each having a central beam 119 and supports 120 connected to and extending generally at right angles from opposite ends of the beam 119. The overall height of the bars 118 is approximately equal to the spacing between surfaces 122, 123 of the flanges 46, 78 respectively and surfaces 124, 125 of the bottom walls 55, 88 respectively. The length of the bars 118 is approximately equal to the spacing between the inside surfaces of the pairs of legs 38, 39 and 71, 72. The beams 119 have through apertures 126 (FIGS. 5, 6) sized to receive the annular bosses 65, 91, and preferably have a friction fit therewith to hold the bars 118 in place during window frame installation. Preferably the bars 118 extend transversely between the pairs of legs 38, 39 and 71, 72 and the supports 120 engage the inside surfaces of the respective legs. The bars 118 have a width in the range of about ½ inch thru about ¾ inch.

The window pane 16 is retained in the window frame 10. The window pane 16 has marginal edge portions received within the window frame groove 34 (the grooves 34A–C) and are retained therein by indirect contact with the side walls 54, 86 and the leg 108. It is preferred that glazing 60 be placed between the window pane marginal edges and the side walls 54, 86 and the leg 108. As seen in FIGS. 2, 3, and 4, the glazing 60 includes a preformed strip 128 of resilient polymeric fire resistant material such as silicon rubber. This strip 128 is applied either to one face of the window pane 16 or to the side walls 54, 86 on one side of the window pane. After the window pane 16 is installed in the groove 34, caulk or other suitable sealant 129, such as silicon based caulk, can be inserted into the groove 34 on the opposite face of the window pane 16 to seal the window pane to the window frame 10 around the entire periphery of the window pane. Also, it is preferred that resilient spacers or pads 131 be positioned between the bottom edge of the window pane 16 and the bottom wall 55 of the sill 30 (FIG. 2). This helps cushion the window pane 16 during and after installation. The pads 131 can also be positioned in the remainder of the groove 34, if desired.

The sill 30, side jambs 31, header 32, filler strip 36 and bars 118 are secured in the wall opening 11 to form the window frame 10. The sill 30 is the bottom of the window frame 10, the header 32 is the top of the window frame, and the side jambs 31 are the sides of the window frame. These parts are sized to appropriate lengths to correspond to the size of the wall opening 11. Preferably the side jambs 32 are installed first and attached in place with the fasteners 55. The side jamb flanges 45, 46 bear against the casing side members 19 which in turn are secured in place as is known in the art. The sill 30 fits between the lower ends of the side jambs 31 and its flanges 45, 46 rest on the casing bottom member 18 which in turn is secured in place as is known in the art. The sill 30 is secured in place with the fasteners 64. The length of the sill 30 is approximately the same as the spacing between the side jamb webs 43. Sealant can be provided at the joints between the ends of the sill 30 and the side jambs 31 to prevent water and air leakage. The channels 83, 84 and bars 118 are then placed at the top of the wall opening 11 and temporarily held in place with the fasteners 100. After positioning and securing the channels 83, 84 and bars 118, the channel 83 is removed and will be reinstalled after the window pane 16 is installed. Removal of the channel 83 provides a taller opening 17 for facilitating insertion of the window pane 16. The notches 90 and bend 99 facilitate reinstallation of the channel 83 after the pane 16 is installed. With the pane 16 in place, the channel 83 is installed and the screws 100 are tightened to secure the channel 83 in place. When the channels 83, 84 are installed, the flanges 77, 78 engage the top casing member 21. If the use of the bars 118 is desired, they are positioned on the annular bosses 65, 91 and installed with the respective frame members. By having the fasteners 64, 100 positioned inside the groove 34, they are not exposed to the elements and cannot be seen.

Figure 7:
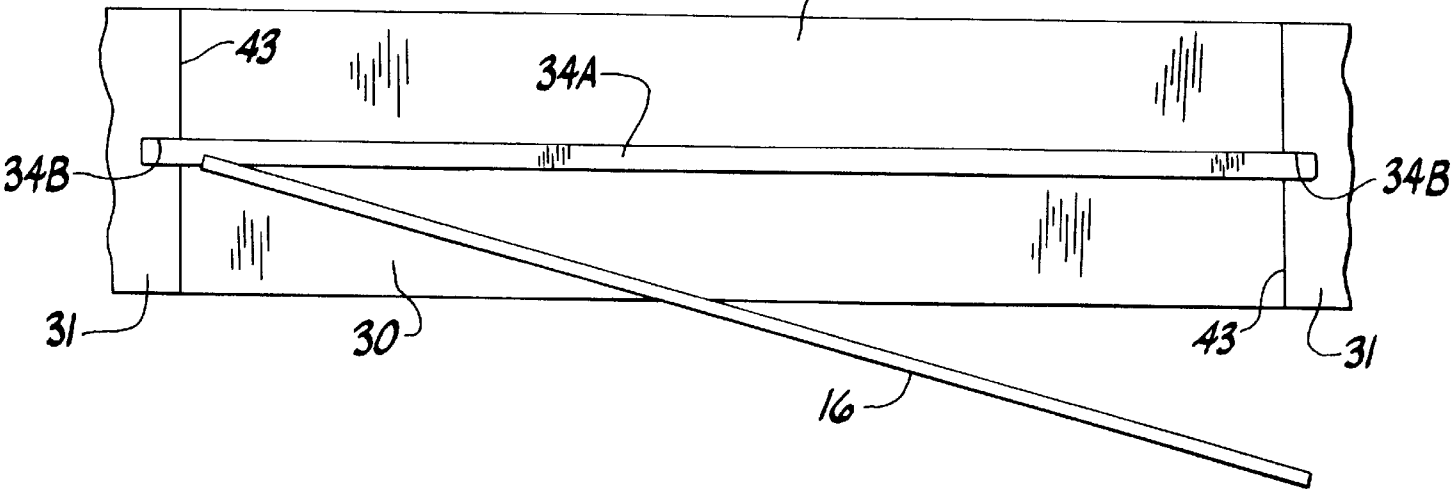
FIGS. 7–10 illustrate the steps involved in mounting a window pane in the window frame of the present invention.
Figure 8:
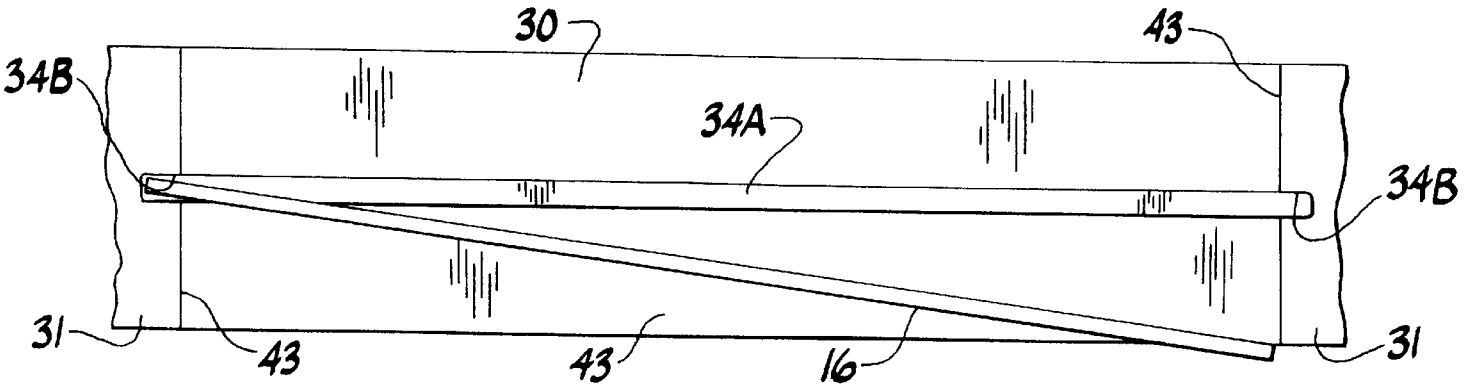
Figure 9:
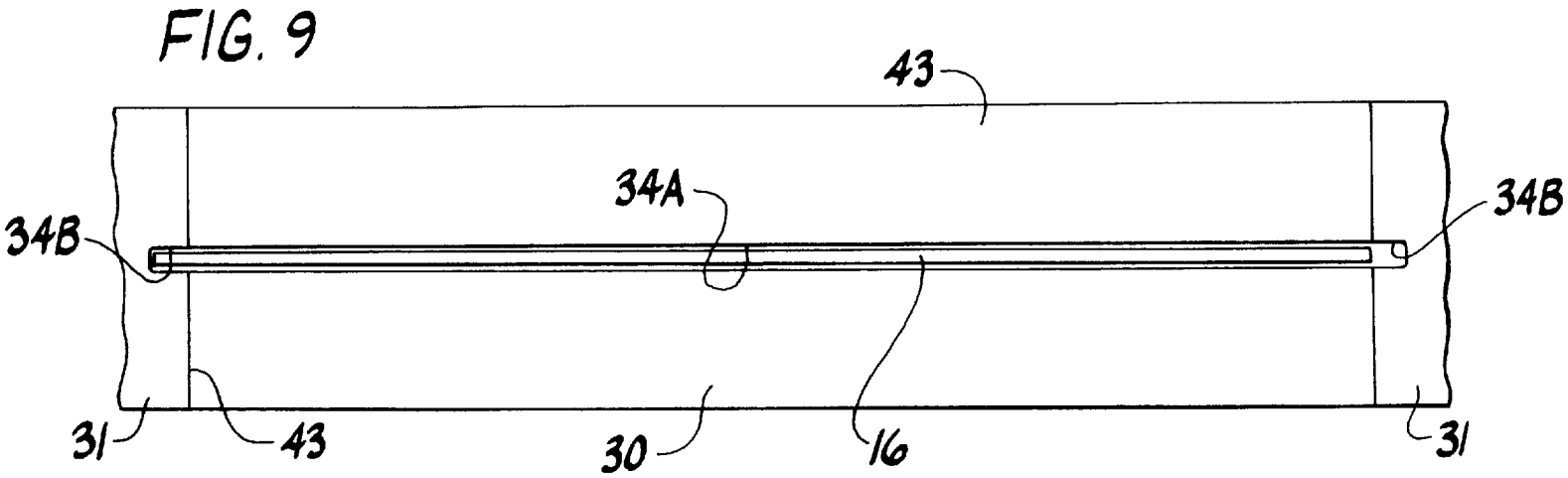
Figure 10:
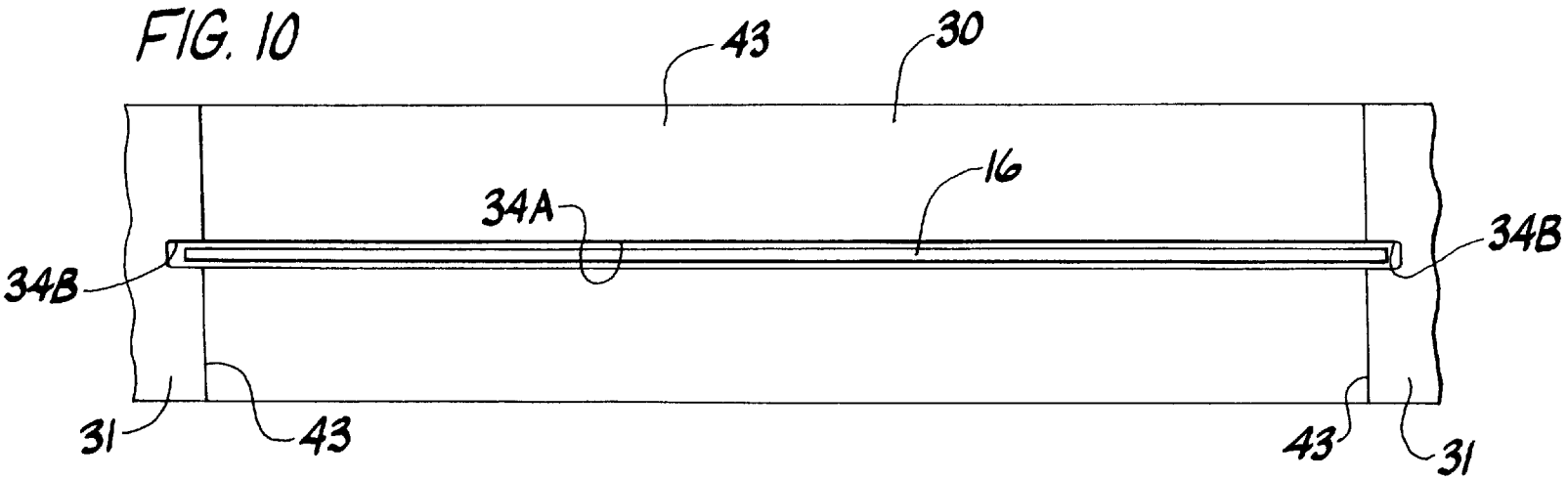

After the sill 30 and side jambs 31 are installed and the channel 84 is in position, the window pane 16 can be installed. The width of the window pane 16 is slightly less than spacing between the bottom wall 55 in the groove 34B of one side jamb 31 and the opposing face of the web 43 of the other side jamb 31. The height of the window pane 16 is also slightly less than the spacing between the bottom wall 88 of the header 32 and the sill web 43. The top of the window pane 16 is positioned adjacent the channel bottom wall 95 and elevated until the bottom of the window pane will move over the sill web 43. With the channel 83 not being installed yet, the window pane 16 can be positioned generally vertically and cocked or rotated slightly so that its profile width is less than spacing between the side jamb webs 43 and thus will fit between the side jambs 31 (FIG. 7). One vertical side edge of the window pane 16 is placed into one of the side jamb grooves 34B, (FIG. 8). The remaining width of the window pane is less than the spacing between the jamb webs 43, so that the window pane 16 can be rotated (FIG. 8) and then moved over the sill groove 34A (FIG. 9) and allowed to slide or move downwardly into the sill groove 34A and onto the spacers 131. The window pane 16 can then be moved laterally sideways whereby both side edges of the window pane are contained within respective side jamb grooves 34B (FIG. 10). The channel 83 is then placed in position. The notches 90 in the channel 83 are aligned with the fasteners 100 allowing the channel 83 to be moved transversely next to the other channel 84 with the wall 88 between the wall 95 and the riser 27 of the casing 21. When in the correct position, the fasteners 100 are tightened securing the channel 84 in place along with the channel 83 and the bars 118, if used. The filler strip 36 is then installed to help retain the window pane 16 in place. The filler strip 36 is installed by first placing the leg 109 in the slot 81. The leg 108 is then placed against the window pane 16 and by resiliently deforming the legs 108, 109, the filler strip is installed in the slot 81 with the tongue 115 being releasably retained in the lock groove 102. The glazing 60 can then be installed to seal the window pane 16 to the window frame 10. The preformed strips of glazing 128 can be attached to the window pane 16 or placed in the grooves 34A–C prior to installation of the window pane 16 if desired and the caulk 129, e.g. silicon caulk, can be installed after the window pane 16 is in place. It is to be understood that the preformed glazing 128 could be used on both sides of the window pane 16 or caulk 129 could be used on both sides of the window pane 16.

As can be seen from the foregoing, a window frame 10 is provided that has a window pane groove 34 that on one face of the window pane 16 is formed by integral portions of each of the frame members 30, 31, 32 thus eliminating the need for separate window pane retainer strips. On the other face of the window pane 16, the window pane groove 34 is also formed by integral portions of each of the frame members 30, 31 also eliminating the need for separate window pane retainer strips. This simplifies installation and also positively secures the window pane in the window frame 10.

The present invention may be used in forms other than those described above. For example, the sill 30, side jambs 31 and header 32 can be made by extrusion and can be made from aluminum or other suitable material including polymers when resistance to high temperature is not a concern. The frame 10 can utilize the structure of the header 32 as a side jamb 31 or as a sill 30 instead of or in addition to the header 32.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A window frame adapted to secure a window pane in place in a window opening, said window frame being adapted to be mounted in an opening in a wall defined by a plurality of casings members, said window frame comprising:

an elongate sill having a window pane receiving groove extending along the length of the sill;

a pair of elongate side jambs each having a window pane receiving groove extending along the length of the respective side jamb;

an elongate header having an elongate slot extending along the length of the header, said slot having opposing sides; and an elongate filler strip having laterally spaced edges releasably retained in the header slot and reducing the transverse width of the header slot to form with the header a window pane receiving groove in the header defined by one of said opposing sides of the slot and one of said laterally spaced edges of the filler strip;

wherein the sill, side jambs and header are positioned relative to one another to form a window frame with the sill groove, side jamb grooves and header groove forming a substantially continuous window pane groove around the inside periphery of the window frame.

2. A window frame as set forth in claim 1 including lock means cooperating with the header and the filler strip to releasably retain the strip in the header.

3. A window frame as set forth in claim 2 wherein the header comprises a pair of elongate channels positioned in side-by-side relation, each channel having a side wall defining one side of the header slot.

4. A window frame as set forth in claim 3 wherein the channels each comprise a bottom wall extending along the length of the respective channel and extending laterally from a respective side wall, a portion of one channel bottom wall at least partially overlapping a portion of the other channel bottom wall and at least one of the channel bottom walls defining the bottom of the header groove.

5. A window frame as set forth in claim 4 wherein the sill and side jambs are each single piece members.

6. A window frame as set forth in claim 5 wherein the sill and the side jambs each have a web and legs extending from opposite sides of the web, and wherein each of said sill and side jamb grooves are in a respective web.

7. A window frame as set forth in claim 6 wherein the sill and side jambs have substantially identical transverse cross sectional shapes.

8. A window frame as set forth in claim 6 wherein:

the sill legs and side jamb legs each includes an inturned flange extending along the length of the respective sill leg and side jamb leg and each spaced from the respective sill web and side jamb web, the inturned flanges of the sill and side jambs being adapted to engage the wall opening casing; and the window frame further includes a plurality of bars extending transversely between the legs of the sill and between the legs of a respective side jamb to reinforce the legs from bending inwardly.

9. A window frame as set forth in claim 4 wherein the lock means comprises a lock groove in one of the header and the filler strip and a tongue on the other of the header and the filler strip, receivable in the lock groove for releasably retaining the filler strip in the header.

10. A window frame as set forth in claim 9 wherein the filler strip comprises a filler strip web and a pair of spaced apart filler strip legs on opposite sides of and extending from the filler strip web, said filler strip legs and filler strip web extend along substantially the entire length of the header, and wherein the filler strip reduces the transverse width of the header slot and one of the filler strip legs defines one side of the header groove.

11. A window frame as set forth in claim 10 wherein the header further comprises first and second elongate members on opposite sides of the header groove, the first member includes a first header leg and a first portion of a header web and the second member includes a second header leg and a second portion of the header web, said first member further includes a third leg forming one side of the header slot and a first bottom wall extending inwardly from the third leg, said second member further includes a fourth leg forming an opposite side of the header slot and a second bottom wall extending inwardly from the fourth leg, said first and second walls overlapping to form a bottom of the header slot.

12. A window frame as set forth in claim 1 wherein:

the sill, side jambs and header each have a bottom wall defining the bottoms of the respective grooves, said bottoms having a plurality of apertures there through; and the window frame further comprises a plurality of fasteners extending through respective said apertures for securing the sill, side jambs, and header to a wall opening casing.

13. A window frame as set forth in claim 1 wherein the sill, side jambs and header each comprise roll formed members.

14. A window frame adapted to secure a window pane in place in a window opening, said window frame being adapted to be mounted in an opening in a wall, said wall opening being defined by a plurality of casings members, said window frame comprising:

an elongate sill having a window pane receiving groove extending along the length of the sill, said sill having a pair of spaced apart sill legs on opposite sides of and extending from a sill web, said sill legs having inside surfaces facing one another;

a pair of elongate side jambs each having a window pane receiving groove extending along a length of the respective side jamb, said side jambs each having a pair of spaced apart side jamb legs on opposite sides of and extending from a respective side jamb web, said side jamb legs of each said side jamb having inside surfaces facing one another;

an elongate header having a groove extending along the length of the header, said header having a pair of spaced apart header legs on opposite sides of and extending from a header web, said header legs having inside surfaces facing one another; and a plurality of longitudinally spaced reinforcing members extending transversely from one of the inside surfaces of the sill legs to another of the inside surfaces of the sill legs, from one of the inside surfaces of the side jamb legs to another of the inside surfaces of the side jamb legs, and from one of the inside surfaces of the header legs to another of the inside surfaces of the header legs to reinforce the respective legs from bending inwardly.

15. A window frame as set forth in claim 14 wherein the sill, side jamb, and header legs have inturned flanges extending along the length of the sill, side jamb, and header legs and being spaced from the respective webs and adapted to engage inside surfaces of an opening in a wall in which the frame is mounted.

16. A window frame as set forth in claim 14 wherein the sill, side jambs and header each comprise roll formed members.

17. A method of installing a window pane in a window frame comprising a sill, a pair of side jambs and a header, said method comprising:

positioning a window pane first side edge in a first edge groove of a first said side jamb;

moving a bottom edge of said window pane over and then into a bottom groove in said sill;

moving a second side edge of said window pane into a second edge groove in a second side jamb by laterally moving said window pane; and joining a first header channel to a preinstalled second header channel, said first and second header channels forming a window pane receiving slot.

18. A method of installing a window pane as set forth in claim 17 further including placing a filler strip in said slot to thereby decrease the width of said slot and releasably retain a top edge portion of the window pane in the header.

19. A window frame adapted to secure a window pane in place in a window opening, said window frame being adapted to be mounted in an opening in a wall defined by a plurality of casings members, said window frame comprising:

an elongate sill having a first window pane receiving groove extending along the length of the sill;

a pair of elongate side jambs each having a second window pane receiving groove extending along the length of the respective side jamb;

an elongate header having a third window pane receiving groove extending along the length of the header;

the sill, side jambs and header being positioned relative to one another to form a window frame with the first, second and third grooves forming a substantially continuous window pane groove around the inside periphery of the window frame;

at least one of the sill, side jambs and header comprising a pair of channels forming an elongate slot there between forming a portion of said continuous window pane groove;

an elongate filler strip releasably retained in the slot reducing the transverse width of the slot and forming with one of the channels, the portion of the continuous window pane receiving groove in said at least one of the sill, side jambs and header; and lock means cooperating with one of said channels and the filler strip to releasably retain the filler strip in said at least one of the sill, side jambs and header.

20. A window frame as set forth in claim 19 wherein the sill, side jambs and header each comprise roll formed members.

* * * * *